US006869741B2

(12) United States Patent
Zhu et al.

(10) Patent No.: US 6,869,741 B2
(45) Date of Patent: Mar. 22, 2005

(54) ELECTROPHOTOGRAPHIC PHOTORECEPTORS WITH NOVEL OVERCOATS

(75) Inventors: Jiayi Zhu, Woodbury, MN (US); Zbigniew Tokarski, Woodbury, MN (US); Ronald J. Moudry, Woodbury, MN (US); Kristine A. Fordahl, Loretto, MN (US); David T. Ask, Somerset, WI (US); Jonas Sidaravicius, Vilnius (LT); Edmundas Montrimas, Vilnius (LT); Kam W. Law, Woodbury, MN (US); Valentas Gaidelis, Vilnius (LT)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/167,932

(22) Filed: Jun. 10, 2002

(65) Prior Publication Data

US 2003/0054272 A1 Mar. 20, 2003

Related U.S. Application Data

(60) Provisional application No. 60/315,796, filed on Aug. 29, 2001, provisional application No. 60/315,788, filed on Aug. 29, 2001, and provisional application No. 60/325,733, filed on Sep. 28, 2001.

(51) Int. Cl.[7] ..... G03G 5/147
(52) U.S. Cl. ..... 430/66; 430/67
(58) Field of Search ..... 430/66, 67

(56) References Cited

U.S. PATENT DOCUMENTS

| | | | | |
|---|---|---|---|---|
| 3,753,709 A | | 8/1973 | Staudenmayer et al. | 96/1.5 |
| 4,006,020 A | | 2/1977 | Polastri | 96/1.5 |
| 4,012,255 A | | 3/1977 | McMullen | 96/1.5 |
| 4,062,681 A | | 12/1977 | Lewis et al. | 96/1.5 |
| 4,181,526 A | | 1/1980 | Blakey et al. | 430/67 |
| 4,301,225 A | | 11/1981 | Herrmann et al. | 430/66 |
| 4,387,148 A | | 6/1983 | Franke et al. | 430/66 |
| 4,472,491 A | | 9/1984 | Wiedemann | 430/58 |
| 4,734,347 A | | 3/1988 | Endo et al. | 430/66 |
| 5,096,796 A | | 3/1992 | Mammino et al. | 430/67 |
| 5,391,449 A | | 2/1995 | Maruyama et al. | 430/66 |
| 6,197,464 B1 | * | 3/2001 | Dinh et al. | 430/66 |

FOREIGN PATENT DOCUMENTS

| | | |
|---|---|---|
| GB | 1500777 | 2/1978 |
| JP | 02176665 | 7/1990 |
| JP | 2000356860 | 12/2000 |

* cited by examiner

*Primary Examiner*—John Goodrow
(74) *Attorney, Agent, or Firm*—Patterson, Thuente, Skaar & Christensen, P.A.

(57) ABSTRACT

A photoreceptor with good mechanical and physical properties is provided with an overcoat layer comprising a copolymer of an α,β-ethylenically unsaturated carboxylic acid and an α,β-ethylenically unsaturated monomer wherein the weight percent of the α,β-ethylenically unsaturated carboxylic-acid is at least 25% up to 99% of the copolymer. The copolymer may comprise an α,β-ethylenically unsaturated carboxylic acid and an α,β-ethylenically unsaturated monomer wherein the copolymer has an acid value of at least 150 mg KOH/g the copolymer. The copolymer may be present in a blend with a second polymer or copolymer comprised of units derived from a second α,β-ethylenically unsaturated monomer that is different from the an α,β-ethylenically unsaturated carboxylic acid and/or the α,β-ethylenically unsaturated monomer. The copolymer or the copolymer blend may be present in a layer that is crosslinked or crosslinkable, the crosslinking being effected through a distinct crosslinking agent that reacts with group(s) on the an α,β-ethylenically unsaturated carboxylic acid or the α,β-ethylenically unsaturated monomer.

42 Claims, No Drawings

ELECTROPHOTOGRAPHIC PHOTORECEPTORS WITH NOVEL OVERCOATS

CROSS REFERENCE TO RELATED APPLICATIONS

This application claims priority to U.S. Provisional Patent Application Ser. Nos. 60/315,796, filed Aug. 29, 2001; 60/315,788, filed Aug. 29, 2001; and 60/325,733, filed Sep. 28, 2001, all of which are incorporated herein by reference.

FIELD OF INVENTION

This invention relates to photoreceptors suitable for use in electrophotography and, more specifically, to photoreceptors having novel overcoats comprising at least a copolymer of an α,β-ethylenically unsaturated carboxylic acid and an α,β-ethylenically unsaturated monomer. The copolymer may be used in a blend of the copolymer with a second polymer derived from an α,β-ethylenically unsaturated monomer. The may also be combined with a cross-linking agent for groups on the copolymer or polymer blended with the copolymer.

BACKGROUND

In electrophotography, a photoreceptor in the form of a plate, belt, disk, or drum having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas, thereby forming a pattern of charged and uncharged areas. A liquid or solid toner is then deposited in either the charged or uncharged areas to create a toned image on the surface of the photoreceptor. The resulting visible toner image can be transferred to a suitable receiving medium such as paper and film, or the photoreceptor surface can operate as a permanent receptor for the image. The imaging process can be repeated many times when a temporary or intermediate receptor is used.

The photoconductive element can be organic or inorganic. Both single layer and multilayer photoconductive elements have been used. In the single layer embodiment, a charge transport material and charge-generating material are combined with a polymeric binder and then deposited on the electrically conductive substrate. In the multilayer embodiment, the charge transport material and charge-generating material are in the form of separate layers, each of which can optionally be combined with a polymeric binder, deposited on the electrically conductive substrate. Two arrangements are possible. In one arrangement (the "dual layer" arrangement), the charge-generating layer is deposited on the electrically conductive substrate and the charge transport layer is deposited on top of the charge-generating layer. In an alternate arrangement (the "inverted dual layer" arrangement), the order of the charge transport layer and charge-generating layer is reversed.

A photoreceptor is required to have desired sensitivity and electrical properties depending on an electrophotographic process applied thereto. A photoreceptor subjected to repetitive uses is also required to have an excellent durability against electrical and mechanical forces applied thereto during corona charging, toner development, transferring to a receiving medium, and cleaning treatment. Furthermore, the surface layer of the photoreceptor may be contaminated by toners, and therefore it should have a good release property. Lastly, the surface of the photoreceptor should have good electroconductive properties so that charge will not remain on the surface of the photoreceptor after discharge to cause a background problem on prints.

For the surface layer of a photoreceptor to possess the above-mentioned desirable properties, photoreceptor may be provided with an overcoat to protect the photoconductive element. The typical overcoats comprise fluorinated polymer, siloxane polymer, fluorosilicone polymer, silane, polyethylene, polypropylene, polyurethane, polycarbonate, polyester, acrylated polyurethane, acrylated polyester, acrylated epoxide resin, or a combination thereof. Although these overcoats provide good abrasion resistance and durability, they are not electroconductive enough.

U.S. Pat. No. 4,006,020 to Polastri discloses an overcoated electrostatographic photoreceptor. The disclosed overcoating comprises a first polymer which is a terpolymer of methyl methacrylate, n-butylacrylate, and acrylic or methacrylic acid, and a second polymer which is a copolymer of styrene and maleic anhydride.

U.S. Pat. No. 3,753,709 to Staudenmayer et al. discloses overcoats for electrophotographic elements wherein the overcoats comprise a copolymer of vinyl acetate with a member selected from the group consisting of the alpha-beta ethylenically unsaturated carboxylic acids, which includes acrylic acid and methacrylic acid.

U.S. Pat. No. 4,181,526 to Blakey et al. discloses overcoats for electrophotographic elements wherein the overcoats comprise a terpolymer of methyl methacrylate, methacrylic acid, and 2-acetoacetoxyethyl methacrylate.

U.S. Pat. No. 4,062,681 to Lewis et al. discloses overcoats for electrophotographic elements wherein the overcoats comprise a polymeric composition such as a homopolymer, copolymer, or blend thereof and an alpha, beta-ethylenically unsaturated carboxylic acid or the partial alkyl ester thereof and at least 20% by weight of an organic cross-linking agent. An example of the overcoat is poly(methyl methacrylate-co-methacrylic acid) cured by an imine-terminated cross-linking agent.

U.S. Pat. No. 4,012,255 to McMullen discloses overcoats for electrophotographic elements wherein the overcoats comprise a terpolymer of 45 to 65 mole percent of methyl methacrylate, 25 to 40 mole percent of n-butylacrylate, and 5 to 15 mole percent of acrylic or methacrylic acid.

U.S. Pat. No. 4,734,347 to Endo et el. discloses overcoats comprising a fluorine-containing copolymer having monomer units of a fluoroolefin and methacrylic acid or acrylic acid.

U.S. Pat. No. 4,301,225 to Herrmann et el. discloses overcoats comprising copolymers of crotonic acid or maleic acid such as vinyl acetate-crotonic acid, vinyl acetate-maleic acid, and styrene-maleic acid.

However, in view of recent requirement of further improved image quality, a protective layer showing further improved properties in respects of electroconductivity, transparency, and durability is desired.

SUMMARY OF THE INVENTION

In a first aspect, the invention features a photoreceptor that includes:

(a) an overcoat layer comprising a copolymer of an α,β-ethylenically unsaturated carboxylic acid and an α,β-ethylenically unsaturated monomer wherein the weight percent of the α,β-ethylenically unsaturated carboxylic acid is at least 25% up to 99% of the copolymer;

(b) a charge transport compound;

(c) a charge-generating compound; and (d) an electrically conductive substrate.

The copolymer may comprise an α,β-ethylenically unsaturated carboxylic acid and an α,β-ethylenically unsaturated monomer wherein the copolymer has an acid value of at least 150 mg KOH/g the copolymer. The copolymer may be present in a blend with a second polymer or copolymer comprised of units derived from a second α,β-ethylenically unsaturated monomer that is different from the an α,β-ethylenically unsaturated carboxylic acid and/or the α,β-ethylenically unsaturated monomer. The copolymer or the copolymer blend may be present in a layer that is crosslinked or crosslinkable (by later treatment), the crosslinkability being effected through a distinct crosslinking agent (by 'distinct' meaning a compound other than the an α,β-ethylenically unsaturated carboxylic acid or the an α,β-ethylenically unsaturated monomer) that reacts with group (s) on the an α,β-ethylenically unsaturated carboxylic acid or the α,β-ethylenically unsaturated monomer.

The invention provides novel overcoats for photoreceptors featuring a combination of good mechanical and electroconductive properties. These photoreceptors can be used successfully with liquid toners to produce high quality images. The high quality of the images is maintained after repeated cycling.

Other features and advantages of the invention will be apparent from the following description of the preferred embodiments thereof, and from the claims.

DETAILED DESCRIPTION OF THE INVENTION

The invention features photoreceptors that include novel overcoat having the formulae set forth in the Summary of the Invention above.

In a first aspect, the invention features a photoreceptor that includes:

(a) an overcoat layer comprising a copolymer of an α,β-ethylenically unsaturated carboxylic acid and an α,β-ethylenically unsaturated monomer wherein the weight percent of the α,β-ethylenically unsaturated carboxylic acid is at least 25% up to 99% of the copolymer;

(b) a charge transport compound;

(e) a charge-generating compound; and (f) an electrically conductive substrate.

The copolymer may comprise an α,β-ethylenically unsaturated carboxylic acid and an α,β-ethylenically unsaturated monomer wherein the copolymer has an acid value of at least 150 mg KOH/g the copolymer. The copolymer may be present in a blend with a second polymer or copolymer comprised of units derived from a second α,β-ethylenically unsaturated monomer that is different from the an α,β-ethylenically unsaturated carboxylic acid and/or the α,β-ethylenically unsaturated monomer. The copolymer or the copolymer blend may be present in a layer that is crosslinked or crosslinkable (by later treatment), the crosslinkability being effected through a distinct crosslinking agent (by 'distinct' meaning a compound other than the an α,β-ethylenically unsaturated carboxylic acid or the an α,β-ethylenically unsaturated monomer) that reacts with group (s) on the an α,β-ethylenically unsaturated carboxylic acid or the α,β-ethylenically unsaturated monomer.

In another aspect, the invention features a photoreceptor that includes:

(a) an overcoat layer comprising a copolymer of an α,β-ethylenically unsaturated carboxylic acid and an α,β-ethylenically unsaturated monomer wherein the weight percent of the α,β-ethylenically unsaturated carboxylic acid is at least 25%;

(b) a charge transport compound;

(c) a charge-generating compound;

(d) an electrically conductive substrate; and (e) less than 10% by weight of a cross-linking agent.

In still a further aspect, the invention features a photoreceptor that includes:

(a) an overcoat layer comprising a blend of a first polymer derived from an α,β-ethylenically unsaturated carboxylic acid and a second polymer derived from an α,β-ethylenically unsaturated monomer wherein the weight percent of the first polymer to the total weight of the overcoat layer is at least 25%;

(b) a charge transport compound;

(c) a charge-generating compound;

(d) an electrically conductive substrate; and (e) optionally a cross-linking agent.

The photoreceptor may be in the form of a plate, drum, disk, or belt, with flexible belts being preferred. The photoreceptor may include an electrically conductive substrate and a photoconductive element in the form of a single layer that includes both the charge transport compound and charge-generating compound in a polymeric binder. Preferably, however, the photoreceptor includes an electrically conductive substrate and a photoconductive element that is a bilayer construction featuring a charge-generating layer and a separate charge transport layer. The charge-generating layer may be located intermediate the electrically conductive substrate and the charge transport layer. Alternatively, the photoconductive element may be an inverted construction in which the charge transport layer is intermediate the electrically conductive substrate and the charge-generating layer.

The electrically conductive substrate may be flexible, for example in the form of a flexible web or a belt, or inflexible, for example in the form of a drum. Typically, a flexible electrically conductive substrate comprises of an insulated substrate and a thin layer of electrically conductive materials. The insulated substrate may be paper or a film forming polymer such as polyethylene terepthalate, polyimide, polysulfone, polyethylene naphthalate, polypropylene, nylon, polyester, polycarbonate, polyvinyl fluoride, polystyrene and the like. Specific examples of supporting substrates included polyethersulfone (STABAR® S-100, available from ICI), polyvinyl fluoride (TEDLAR®, available from E. I. DuPont de Nemours & Company), polybisphenol-A polycarbonate (MACROFOL®, available from Mobay Chemical Company) and amorphous polyethylene terephthalate (MELINAR®, available from ICI Americas, Inc.). The electrically conductive materials may be graphite, dispersed carbon black, iodide, conductive polymers such as polypyroles and CALGON® Conductive polymer 261 (commercially available from Calgon Corporation, Inc., Pittsburgh, Pa.), metals such as aluminum, titanium, chromium, brass, gold, copper, palladium, nickel, or stainless steel, or metal oxide such as tin oxide or indium oxide. Preferably, the electrically conductive material is aluminum. Typically, the photoconductor substrate will have a thickness adequate to provide the required mechanical stability. For example, flexible web substrates generally have a thickness from about 0.01 to about 1 mm, while drum substrates generally have a thickness of from about 0.5 mm to about 2 mm.

The charge-generating compound is a material that is capable of absorbing light to generate charge carriers, such as a dyestuff or pigment. Examples of suitable charge-generating compounds include metal-free phthalocyanines (e.g., PROGEN™ 1 x-form metal-free phthalocyanine from Zeneca, Inc.), metal phthalocyanines such as titanium phthalocyanine, copper phthalocyanine, oxytitanium phthalocyanine, hydroxygallium phthalocyanine, squarylium dyes and pigments, hydroxy-substituted squarylium pigments, perylimides, polynuclear quinones available from Allied Chemical Corporation under the tradename INDOFAST™ Double Scarlet, INDOFAST™ Violet Lake B, INDOFAST™ Brilliant Scarlet and INDOFAST™ Orange, quinacridones available from DuPont under the tradename MONASTRAL™ Red, MONASTRAL™ Violet and MONASTRAL™ Red Y, naphthalene 1,4,5,8-tetracarboxylic acid derived pigments including the perinones, tetrabenzoporphyrins and tetranaphthaloporphyrins, indigo- and thioindigo dyes, benzothioxanthene-derivatives, perylene 3,4,9,10-tetracarboxylic acid derived pigments, polyazo-pigments including bisazo-, trisazo- and tetrakisazo-pigments, polymethine dyes, dyes containing quinazoline groups, tertiary amines, amorphous selenium, selenium alloys such as selenium-tellurium, selenium-tellurium-arsenic and selenium-arsenic, cadmium sulfoselenide, cadmiumselenide, cadmium sulfide, and mixtures thereof Preferably, the charge-generating compound is oxytitanium phthalocyanine, hydroxygallium phthalocyanine or a combination thereof.

Preferably, the charge generation layer comprises a binder in an amount of from about 10 to about 90 weight percent and more preferably in an amount of from about 20 to about 75 weight percent, based on the weight of the charge generation layer There are many kinds of charge transport compound available for electrophotography. Suitable charge transport compounds for use in the charge transport layer include, but are not limited to, pyrazoline derivatives, fluorine derivatives, oxadiazole derivatives, stilbene derivatives, hydrazone derivatives, carbazole hydrazone derivatives, triaryl amines, polyvinyl carbazole, polyvinyl pyrene, polyacenaphthylene, or multi-hydrazone compounds comprising at least two hydrazone groups and at least two groups selected from the group consisting of triphenylamine and heterocycles such as carbazole, julolidine, phenothiazine, phenazine, phenoxazine, phenoxathiin, thiazole, oxazole, isoxazole, dibenzo(1,4)dioxine, thianthrene, imidazole, benzothiazole, benzotriazole, benzoxazole, benzimidazole, quinoline, isoquinoline, quinoxaline, indole, indazole, pyrrole, purine, pyridine, pyridazine, pyrimidine, pyrazine, triazole, oxadiazole, tetrazole, thiadiazole, benzisoxazole, benzisothiazole, dibenzofuran, dibenzothiophene, thiophene, thianaphthene, quinazoline, or cinnoline. These multi-hydrazone compounds are described in U.S. Pat. No. 6,066,426, and U.S. Provisional Application Ser. Nos. 60/242517, 60/296803, 60/296806, 60/296822, 60/296979, 60/303567, and 60/303631. The patent and provisional applications are hereby incorporated by reference. Other suitable charge transport compounds include carbazole 1,1-dinaphthylhydrazone and its derivatives as described in U.S. Provisional Application Ser. No. 60/311601, which is hereby incorporated by reference.

The charge transport layer typically comprises a charge transport material in an amount of from about 25 to about 60 weight percent, based on the weight of the charge transport layer, and more preferably in an amount of from about 35 to about 50 weight percent, based on the weight of the charge transport layer; with the remainder of the charge transport layer comprising the binder, and optionally any conventional additives. The charge transport layer will typically have a thickness of from about 10 to about 40 microns and may be formed in accordance with any conventional technique known in the art.

Conveniently, the charge transport layer may be formed by dispersing or dissolving the charge transport material and a polymeric binder in organic solvent, coating the dispersion and/or solution on the respective underlying layer and drying the coating. Likewise, the charge generation layer may be formed by dissolving or dispersing the charge generation compound and the polymeric binders in organic solvent, coating the solution or dispersion on the respective underlying layer and drying the coating.

The binder is capable of dispersing or dissolving the charge transport compound (in the case of the charge transport layer) and the charge-generating compound (in the case of the charge-generating layer). Examples of suitable binders for both the charge-generating layer and charge transport layer include polystyrene-co-butadiene, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly (hydroxyether) resins, polyhydroxystyrene resins, novolak, poly(phenylglycidyl ether)-co-dicyclopentadiene, copolymers of monomers used in the above-mentioned polymers, and combinations thereof Polycarbonate binders are particularly preferred. Examples of suitable polycarbonate binders include polycarbonate A which is derived from bisphenol-A, polycarbonate Z, which is derived from cyclohexylidene bisphenol, polycarbonate C, which is derived from methylbisphenol A, and polyestercarbonates.

The overcoat for this invention includes at least one copolymer of an α,β-ethylenically unsaturated carboxylic acid and an α,β-ethylenically unsaturated monomer wherein the weight percent of the α,β-ethylenically unsaturated carboxylic acid is at least 25%, up to 99% by weight of the α,β-ethylenically unsaturated carboxylic acid.

Non-limiting examples for the α,β-ethylenically unsaturated carboxylic acid are 4-vinylbenzoic acid, fumaric acid, cinnamic acid, sorbic acid, mesaconic acid, maleic acid, glutaconic acid, citraconic acid, itaconic acid, indene-3-carboxylic acid, acrylic acid, methacrylic acid, crotonic acid, 2-methacryloyloxyethyl hydrogen phthalate, 4-methacrylamidobenzoic acid, mono-(2-methacryloyloxyethyl)-succinic acid, and 2-methyl-2-pentenoic acid. The preferred acid-containing α,β-ethylenically unsaturated carboxylic acid are acrylic acid and methacrylic acid.

Non-limiting examples for the α,β-ethylenically unsaturated monomer are styrene, vinyl acetate, fluoroolefin, methyl acrylate, ethyl acrylate, butyl acrylate, methyl methacrylate, ethyl methacrylate, butyl methacrylate, isobornyl acrylate, isobornyl methacrylate and other acrylates and methacrylates. Groups such as the alkyl groups (e.g., methyl, ethyl, butyl, etc.) on the acrylates and methacrylates may also be substituted to adjust physical properties, especially surface tension, oleophilicity, and hydrophilicity of the copolymer. Such substituents may include alkyl groups, alkoxy groups, halogen atoms or halogenated groups, cyano groups, perhalogenated (especially perfluorinated) groups, and the like. The preferred α,β-ethylenically unsaturated monomers are methyl methacrylate and ethyl acrylate.

The optimal weight percentage of the α,β-ethylenically unsaturated carboxylic acid in the copolymer is on the order of 10% to 99%, 10% to 95%, preferably between 20% and 90%, and most preferably between 30% and 80%. Undesirable effects may accompany the weight percentage selected outside of these ranges. For example, at high weight percentage (above 95%), the copolymer may become too moisture sensitive. At low weight percentage (below 10%), the copolymer may have insufficient electroconductivity. Additional additives or comonomers may be added to extend these ranges by ameliorating these properties cause by extremes in the ranges.

The optimal acid value of the copolymer is on the order of 60 to 750 mg KOH/g of copolymer, preferably between 120 and 700 mg KOH/g of copolymer, and most preferably between 150 and 600 mg KOH/g of copolymer. Undesirable effects may accompany the acid value selected outside of these ranges. For example, at high acid value (above 750 mg KOH/g of copolymer), the copolymer may become too moisture sensitive. At low weight percentage (below 60 mg KOH/g of copolymer), the copolymer may have insufficient electroconductivitiy.

The acid value can be measured by a method according to JIS (Japanese Industrial Standard) K0070. Specifically, the dispersant polymer is dissolved in a good solvent, and then phenolphthalein is added thereinto as an indicator. Titration is then carried out using a 0 .mol/liter solution of potassium hydroxide in ethanol. The amount of the dispersant polymer, which is a sample, is 20 g, 10 g, 5 g, 2 g and 1 g in the case wherein the acid value is less than 5, not less than 5 and less than 15, not less than 15 and less than 30, not less than 30 and less than 100, and 100 or more, respectively. The acid value is calculated by using the value from the titration and the following equation:

$$\text{Acid value}=B\times F\times 5.611/S,$$

wherein B represents the amount (ml) of the 0.1 mol/liter solution of potassium hydroxide in ethanol which is required for the titration, F represents a factor of the 0.1 mol/liter solution of potassium hydroxide in ethanol, and S represents the weight (g) of a sample.

The cross-linking agent employed in the overcoat used in the present invention can be any of a number of well-known substances widely used for this purpose. Non-limiting examples of suitable cross-linking agent are diepoxy reactive modifiers, such as 1,4-butanedioldiglycidyl ether, aminoplast resins such as urea-formaldehyde resins and melamine-formaldehyde resins, triazine derivatives, diazine derivatives, triazole derivatives, guanidine derivatives, guanamine derivatives, phenolic resins, imine-terminated prepolymers, polyfunctional aziridines such as IONAC PFAZ-322, IONAC XAMA-2, and IONAC XAMA-7 (Sybron Chemicals, Inc., Birmingham, N.J.). The preferred cross-linking agent is IONAC PFAZ-322, a polyfunctional aziridine.

The optimal amount of cross-linking agent is from about 0.5 to about 10% by weight. The preferred amount of cross-linking agent is from 1% to 8% by weight. The most preferred amount is from 2% to 5% by weight. The crosslinker should be dissolved in a dilute solution before adding to the overcoat solution in order to prevent the precipitation of locally crosslinked polymers.

In the practice of the invention wherein a blend of the copolymer and the second polymer (the term 'polymer' including homopolymers, copolymers, terpolymers, tetrapolymers and the like) is used, non-limiting examples of suitable overcoat for this invention includes a blend of a first polymer derived from an α,β-ethylenically unsaturated carboxylic acid and a second polymer derived from an α,β-ethylenically unsaturated monomer wherein the weight percent of the first polymer is at least 25%. The use of these terms in this description are consistent with the definitions provided above.

Non-limiting examples of α,β-ethylenically unsaturated monomer are styrene, vinyl acetate, fluoroolefin, methyl acrylate, ethyl acrylate, butyl acrylate, methyl (methacrylate), ethyl(methacrylate), butyl(methacrylate), and other acrylates and methacrylates. The preferred α,β-ethylenically unsaturated monomer are methylmethacrylate and ethylacrylate.

The optimal weight percentage of the first polymer in the blend is in the order of 10% to 95%, preferably between 20% and 90%, and most preferably between 30% and 80%. Undesirable effects may accompany the weight percentage selected outside of these ranges. For example, at high weight percentage (above 95%), the copolymer may become too moisture sensitive. At low weight percentage (below 10%), the copolymer may have insufficient electroconductivitiy.

The optimal acid value of the blend is in the order of 60 to 750 mg KOH/g of blend, preferably between 120 and 700 mg KOH/g of blend, and most preferably between 150 and 600 mg KOH/g of blend. Undesirable effects may accompany the acid value selected outside of these ranges. For example, at high acid value (above 750 mg KOH/g of blend), the blend may become too moisture sensitive. At low weight percentage (below 60 mg KOH/g of blend), the blend may have insufficient electroconductivitiy.

The photoreceptor may include other layers in addition to the overcoat layer. Such layers are well-known and include, for example, barrier layers, adhesive layers, and sub-layers. The overcoat layer forms the uppermost layer of the photoconductor element with the barrier layer sandwiched between the overcoat layer and the photoconductive element. The adhesive layer locates and improves the adhesion between the barrier layer and the overcoat layer. The sub-layer is a charge blocking layer and locates between the electrically conductive substrate and the photoconductive element. The sub-layer may also improve the adhesion between the electrically conductive substrate and the photoconductive element.

Particularly suitable barrier layers include coatings such as crosslinkable siloxanol-colloidal silica coating and hydroxylated silsesquioxane-colloidal silica coating, and organic binders such as polyvinyl alcohol, methyl vinyl ether/maleic anhydride copolymer, casein, polyvinyl pyrrolidone, polyacrylic acid, gelatin, starch, polyurethanes, polyimides, polyesters, polyamides, polyvinyl acetate, polyvinyl chloride, polyvinylidene chloride, polycarbonates, polyninyl butyral, polyvinyl acetoacetal, polyvinyl formal, polyacrylonitrile, polymethyl methacrylate, polyacrylates, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above organic binders optionally may contain small inorganic particles such as fumed silica, silica, titania, alumina, zirconia, or a combination thereof. The typical particle size is in the range of 0.001 to 0.5 micrometers, preferably 0.005 micrometers. A preferred barrier layer is a 1:1 mixture of methyl cellulose and methyl vinyl ether/maleic anhydride copolymer with glyoxal as a crosslinker.

Non-limiting examples of acid-containing polymerizable organic compounds are 4-vinylbenzoic acid, fumaric acid, cinnamic acid, sorbic acid, mesaconic acid, maleic acid, glutaconic acid, citraconic acid, itaconic acid, indene-3-carboxylic acid, and alpha-beta unsaturated alkenoic acids such as acrylic acid, methacrylic acid, crotonic acid, 2-methacryloyloxyethyl hydrogen phthalate, 4-methacrylamidobenzoic acid, mono-(2-methacryloyloxyethyl)-succinic acid, and 2-methyl-2-pentenoic acid. The preferred acid-containing polymerizable organic compounds are acrylic acid and methacrylic acid.

Typical adhesive layers include film forming polymers such as polyester, polyacrylates, polyvinylbutyral, polyvinylpyrolidone, polyurethane, polymethyl methacrylate, poly(hydroxy amino ether) and the like. Preferably, the adhesive layer is poly(hydroxy amino ether). If such layers are utilized, they preferably have a dry thickness between about 0.01 micrometer and about 5 micrometers.

Typical sub-layers include polyvinylbutyral, organosilanes, hydrolyzable silanes, epoxy resins, polyesters, polyamides, polyurethanes, silicones and the like. Preferably, the sub-layer has a dry thickness between about 20 Angstroms and about 2,000 Angstroms.

The overcoat layers, and photoreceptors including these overcoat layers, are suitable for use in an imaging process with either dry or liquid toner development. Liquid toner development is generally preferred because it offers the advantages of providing higher resolution images and requiring lower energy for image fixing compared to dry toners. Examples of useful liquid toners are well-known. They typically include a colorant, a resin binder, a charge director, and a carrier liquid. A preferred resin to pigment ratio is 2:1 to 10:1, more preferably 4:1 to 8:1. Typically, the colorant, resin, and the charge director form the toner particles.

The invention will now be described further by way of the following examples.

EXAMPLES

Comparative Example A

Comparative Example A was a photoreceptor sheet obtained by the method described in Example 2 of U.S. Pat. No. 6,066,426. The size of the sheet was about 20 cm×100 cm.

Example 1

An overcoat solution of poly(methacrylic acid) (commercially obtained from Polysciences, Inc., Warrington, Pa.) was prepared by dissolving 4.0 g of the polymer in a mixture of solvents formed by 38.0 g of ethanol and 38.0 g of de-ionized water. The overcoat solution was ready for use after it was left on a mechanical shaker overnight. The overcoat of the polymer was made by spreading the polymer solution using a knife coater with 40 micron of gap space onto a photoreceptor sheet same as Comparative Example A. The coated sample was then dried in an oven at 80° C. for 10 min.

Example 2

Example 2 was prepared in the same way as Example 1, except that the polymer used for the overcoat was poly (methyl methacrylate-co-methacrylic acid) having 75% by weight of poly(methacrylic acid) (obtained from Department of Solid State Electronics, Vilnius University, Vilnius, Lithuania), and that the solvent was a mixture of 38.0 g of acetone, 19.0 g of ethanol, and 19.0 g of de-ionized water.

Example 3

Example 3 was prepared in the same way as for Example 1, except that the polymer used for the overcoat was poly(methyl methacrylate-co-methacrylic acid) having 25% by weight of poly(methacrylic acid) (commercially obtained from Polysciences, Inc., Warrington, Pa.) and that the solvent was a mixture of 54.3 g of acetone and 21.7 g of ethanol.

Example 4

Example 4 was prepared in the same way as Example 1, except that the polymer used for the overcoat was poly (methyl methacrylate-co-methacrylic acid) having 5% by weight of poly(methacrylic acid) (commercially obtained from Polysciences, Inc., Warrington, Pa.) and that the solvent was a mixture of 38.0 g of acetone and 38.0 g of ethyl acetate.

Example 5

Example 5 was prepared in the same way as Example 4, except that the polymer used for the overcoat was poly (methyl methacrylate-co-methacrylic acid) having 2% by weight of poly(methacrylic acid) (commercially obtained from Aldrich, Milwaukee, Wis.).

Example 6

Example 6 was prepared in the same way as Example 4, except that the polymer used for the overcoat was poly (methyl methacrylate) (commercially obtained from Aldrich, Milwaukee, Wis.).

Example 7

The overcoat of Example 7 was prepared in the same way as for Example 1, except that the polymer used for the overcoat was poly(acrylic acid) (commercially obtained from Aldrich, Milwaukee, Wis.).

Water Solubility Test

The water solubility of the overcoat was tested on each of the examples mentioned above which were cut into sheets of about 10×10 $cm^2$. The test was done by placing a few drops of water on each of the examples and rubbing it firmly with a cotton swab for up to about 30 seconds. If the overcoat was removed by rubbing, the water solubility of the overcoat was rated as 4. Otherwise, the tested example was soaked in water for overnight and the rubbing test was repeated. If the overcoat was removed by rubbing this time, the water solubility of the overcoat was rated as 3. If no overcoat was removed, but the overcoat was discolored, the sample was then let air-dry for about 4 hours and the overcoat was examined again. If the coating was still discolored, the water solubility of the overcoat was rated as 2. If the discoloring of the coating was disappeared after air-dry, the water solubility of the overcoat was rated as 1. If no changes at all on the overcoat during the above test, the water solubility of the overcoat was rated as 0.

Electrostatic Test

A test series was designed to evaluate the electrostatic cycling performance of a photoreceptor sheet at ambient (i.e., about 25 degree C. and 45% to 75% of relative humidity). The coated photoreceptor sheet was cut into 50 cm long by 8.8 cm wide sample and fastened around an aluminum drum (50 cm circumference). During the test, the drum rotated at a rate of 8.1 cm/sec. while the erase, corona charging, and laser discharge stations were located at approximately −80 degree, +45 degree, and +90 degree positions, respectively, from the top of the drum. The first electrostatic probe (Trek 344 electrostatic meter, from Trek Inc., Medina N.Y.) was located immediately after the laser discharge station and the second identical probe at 180 degree from the top of the drum.

The sample was completely charged for three cycles (drum rotations); discharged with the laser at 780 nm, 600 dpi on the forth cycle to obtained the discharge voltage; completely charged for the next three cycles to obtain charge acceptance voltage; discharged with only the erase lamp at 720 nm on the eighth cycle to obtain residue voltage; and, finally, completely charged for the last three cycles. Charge acceptance and discharge voltages were recorded by the electrostatic probes described above.

Taber Abrasion Test

Abrasion resistances of Comparative Example A and Examples 1–6 were tested according to ASTM D-4060 using a Taber Abraser (model 505, commercially obtained from Teledyne Taber North Tonawanda, N.Y.). To run the test, a sample was cut into 10 cm in diameter by a die cutter, mounted onto a sample holder so that the sample was immersed in the toner carrier liquid during the test, and was abraded with a pair of CS-10F rubber wheels (commercially obtained from Paul N. Gardner Company, Inc., Pompano Beach, Fla.) under 250 g for 1000 cycles. After the test, the sample was allowed to dry at ambient and the abrasion on surface of a tested sample was visually evaluated for light or heavy abrasion.

Comparative Example B

Comparative Example B was prepared with an overcoat formed by a non-crosslinked copolymer of poly(methyl methacrylate-co-methacrylic acid) having 75% by weight of poly(methacrylic acid) (obtained from Department of Solid State Electronics, Vilnius University, Vilnius, Lithuania). The overcoat solution was prepared by dissolving 4.0 g of the copolymer in a mixture of 38.0 g of acetone, 19.0 g of ethanol and 19.0 g of de-ionized water. The overcoat solution was ready for use after it was left on a mechanical shaker for overnight. The overcoat of the copolymer was then made by spreading the copolymer solution using a knife coater with 40 micron of gap space onto a photoreceptor sheet obtained by the method described in Example 2 of U.S. Pat. No. 6,066,426. The size of the sheet was about 20 cm×100 cm. The coated photoreceptor was then dried in an oven at 80° C. for 10 min.

Example 8

Example 8 was prepared with an overcoat formed by the copolymer described in Comparative Example B crosslinked with IONAC PFAZ-322 (a polyfunctional aziridine commercially available from Sybron Chemicals Inc., Birmingham, N.J.) at 0.5% by weight of the copolymer. The overcoat solution was prepared by first dissolving 0.2 g of the crosslinker in a mixture of 49.8 g of acetone, 25.0 g of ethanol, and 25.0 g of de-ionized water to form a crosslinker solution. Then in a separate container was dissolved 1.5 g of the copolymer in a mixture of 12.4 g of acetone, 6.2 g of ethanol, and 6.2 g of de-ionized water. Finally, to this copolymer solution was added 3.8 g of the crosslinker solution. The overcoat solution was coated onto a photoreceptor by the same coating procedure as described for Comparative Example B, except that the coated photoreceptor was cured in an oven at 110° C. for 20 min.

Examples 9 and 10

Examples 9 and 10 were prepared similarly according to the procedure for Example 8, except that the amount of IONAC PFAZ-322 was increased to 1% and 2% by weight of the copolymer respectively.

TABLE 1

Electrostatic And Taber Abrasion Test Results of Comparative Example A and Examples 1–7.

| Sample | Methacrylic Acid % in P(MMA-MAA) | Results of Electrostatic Test (voltage) | | | Results of Taber Abrasion Test |
|---|---|---|---|---|---|
| | | Charge Acceptance | Discharge | Residue | |
| Comparative A | N/A | 550 | 40 | 20 | Heavy |
| Example 1 | 100% | 520 | 40 | 20 | Light |
| Example 2 | 75% | 550 | 40 | 20 | Light |
| Example 3 | 25% | 580 | 140 | 80 | Light |
| Example 4 | 5% | 640 | 170 | 160 | Light |
| Example 5 | 2% | 620 | 120 | 100 | Light |
| Example 6 | 0% | 650 | 190 | 190 | Light |
| Example 7* | 0% | 540 | 30 | 10 | Light |

Note: *Example 7 was poly(acrylic acid).

TABLE 1

The Water Solubility And Electrostatic Results of Comparative Example B and Examples 8–10.

| Samples | Crosslinker Wt % of Polymer | Water Solubility | Exposure to High Humidity* | Electrostatic Vacc | Vdis | Vres |
|---|---|---|---|---|---|---|
| Comparative B | None | 4 | Before | 580 | 40 | 20 |
| | | | After | 570 | 70 | 30 |
| Example 8 | 0.5% | 4 | Before | 610 | 50 | 20 |
| | | | After | 580 | 40 | 20 |
| Example 9 | 1.0% | 1 | Before | 600 | 50 | 20 |
| | | | After | 560 | 50 | 20 |
| Example 10 | 2.0% | 0 | Before | 580 | 50 | 20 |
| | | | After | 580 | 40 | 20 |

Note: *Electrostatic test was run at ambient condition before and after the samples were exposed to high humidity (90% relative humidity) in an environmental chamber at 30° C. for 24 hours.

Example 11

Example 11 was prepared with an overcoat formed with the copolymer described in Comparative Example B crosslinked with 1,4-butanediol diglycidyl ether (Aldrich Chemical Co., Wisconsin) as 1% by weight of the copolymer. The overcoat solution was prepared by first dissolving 0.5 g of the crosslinker in a mixture of 4.7 g of acetone, 2.4 g of ethanol, and 2.4 g of de-ionized water to form a crosslinker solution. In a separate container was dissolved 1.5 g of the copolymer in a mixture of 14.3 g of acetone, 7.1 g of ethanol, and 7.1 g of de-ionized water. To this copolymer solution was added 0.3 g of the crosslinker solution. The overcoat solution was coated onto a photoreceptor by the same coating procedure as described for Comparative Example B, except that the coated photoreceptor was cured in an oven at 110° C. for 20 min.

Examples 12, 13, and 14

Examples 12 to 14 were prepared similarly according to the procedure for Example 11, except that the amount of 1,4-butanediol diglycidyl ether was increased to 5%, 15%, and 25% by weight of the copolymer respectively.

The above examples are provided in an effort to enable a broad scope of the practice of the invention and should not be considered in a manner that limits or narrows the broad disclosure of the invention. For example, where the copolymer is shown without a blend present, that example cannot be read to exclude blends of resins from the practice of the present invention. Similarly, where the examples show an overcoat with a crosslinking agent or a specific amount of crosslinking agent, that example should not limit the practice of the invention that includes an overcoat free of second polymers and crosslinking agents.

What is claimed is:

1. A photoreceptor comprising:

(a) an overcoat layer having a polymer composition comprising a crosslinked copolymer of an α,β-ethylenically unsaturated carboxylic acid and an α,β-ethylenically unsaturated monomer selected from the group consisting of styrene, fluoroolefins, acrylates and methacrylates wherein the weight percent of the α,β-ethylenically unsaturated carboxylic acid is at least 25% of the total weight of the copolymer;

(b) a charge transport compound;

TABLE 2

The Water Solubility And Electrostatic Results of Comparative Example B and Examples 8–14.

| Samples | Crosslinker Wt % of Polymer | Water Solubility | Exposure to High Humidity* | Electrostatic Vacc | Vdis | Vres |
|---|---|---|---|---|---|---|
| Comparative B | None | 4 | Before | 580 | 40 | 20 |
| | | | After | 570 | 70 | 30 |
| Example 8 | 0.5% | 4 | Before | 610 | 50 | 20 |
| | | | After | 580 | 40 | 20 |
| Example 9 | 1.0% | 1 | Before | 600 | 50 | 20 |
| | | | After | 560 | 50 | 20 |
| Example 10 | 2.0% | 0 | Before | 580 | 50 | 20 |
| | | | After | 580 | 40 | 20 |
| Example 11 | 1.0% | 4 | Before | 600 | 30 | 20 |
| | | | After | 540 | 30 | 20 |
| Example 12 | 5.0% | 2 | Before | 580 | 40 | 20 |
| | | | After | 550 | 40 | 20 |
| Example 13 | 15.0% | 2 | Before | 600 | 30 | 20 |
| | | | After | 600 | 30 | 20 |
| Example 14 | 25.0% | 0 | Before | 580 | 40 | 20 |
| | | | After | 580 | 40 | 20 |

Note: *Electrostatic test was run at ambient conditions before and after the samples were exposed to high humidity (90% relative humidity) in an environmental chamber at 30° C. for 24 hours.

(c) a charge-generating compound; and (d) an electrically conductive substrate.

2. A photoreceptor according to claim 1 wherein the α,β-ethylenically unsaturated carboxylic acid is methacrylic acid and the α,β-ethylenically unsaturated monomer is methyl methacrylate.

3. A photoreceptor according to claims 1 and 2 wherein the weight percent of the α,β-ethylenically unsaturated carboxylic acid is at least 50%.

4. A photoreceptor according to claim 1 wherein the charge transport compound comprises at least two heterocycles and at least two hydrazone groups.

5. A photoreceptor according to claim 1 wherein the charge transport compound comprises at least two carbazole groups and at least two hydrazone groups.

6. A photoreceptor according to claim 1 wherein the charge transport compound comprises a carbazole 1,1-dinaphthylhydrazone derivative.

7. A photoreceptor comprising:

(a) an overcoat layer having a polymer composition comprising a crosslinked copolymer of an α,β-ethylenically unsaturated carboxylic acid and an α,β-ethylenically unsaturated monomer selected from the group consisting of styrene, fluoroolefins, acrylates and methacrylates wherein the copolymer has an acid value of at least 150 mg KOH/g the copolymer;

(b) a charge transport compound;

(c) a charge-generating compound; and (d) an electrically conductive substrate.

8. A photoreceptor according to claim 7 wherein the α,β-ethylenically unsaturated carboxylic acid is methacrylic acid and the α,β-ethylenically unsaturated monomer is methyl methacrylate.

9. A photoreceptor according to claim 8 wherein the copolymer has an acid value of at least 300 mg KOH/g the copolymer.

10. A photoreceptor according to claim 7 wherein the charge transport compound comprises at least two heterocycles and at least two hydrazone groups.

11. A photoreceptor according to claim 7 wherein the charge transport compound comprises at least two carbazole groups and at least two hydrazone groups.

12. A photoreceptor according to claim 7 wherein the charge transport compound comprises a carbazole 1,1-dinaphthylhydrazone derivative.

13. The photoreceptor of claim 1 wherein the overcoat layer contains a crosslinking effective amount of a crosslinking agent as less than 10% by weight of the overcoat layer.

14. A photoreceptor according to claim 13 wherein the α,β-ethylenically unsaturated carboxylic acid is methacrylic acid and the α,β-ethylenically unsaturated monomer is methyl methacrylate.

15. A photoreceptor according to claim 13 wherein the weight percent of the α,β-ethylenically unsaturated carboxylic acid is at least 50%.

16. A photoreceptor according to claim 14 wherein the amount of the cross-linking agent is less than 5%.

17. A photoreceptor according to claim 13 wherein the organic cross-linking agent is a polyfunctional aziridine.

18. A photoreceptor according to claim 13 wherein the charge transport compound comprises at least two carbazole groups and at least two hydrazone groups.

19. A photoreceptor according to claim 13 wherein the charge transport compound comprises at least two heterocycles and at least two hydrazone groups.

20. A photoreceptor according to claim 13 wherein the overcoat layer comprises a copolymer of an α,β-ethylenically unsaturated carboxylic acid and an α,β-ethylenically unsaturated monomer wherein the copolymer has an acid value of at least 150 mg KOH/g of the copolymer.

21. A photoreceptor according to claim 20 wherein the α,β-ethylenically unsaturated carboxylic acid is methacrylic acid and the α,β-ethylenically unsaturated monomer is methyl methacrylate.

22. A photoreceptor according to claims 20 wherein the acid value of the copolymer is at least 300 mg KOH/g of the copolymer.

23. A photoreceptor according to claim 13 wherein the amount of the cross-linking agent is less than 5%.

24. A photoreceptor according to claims 13 wherein the crosslinking agent is a polyfunctional aziridine.

25. A photoreceptor comprising:

(a) an overcoat layer;

(b) a charge transport compound;

(c) a charge-generating compound; and (d) an electrically conductive substrate, wherein the overcoat layer comprises a blend of a first polymer derived from an α,β-ethylenically unsaturated carboxylic acid and a second polymer derived from an α,β-ethylenically unsaturated monomer selected from the group consisting of styrene, fluoroolefins, acrylates and methacrylates wherein the weight percent of the first polymer to the total weight of the overcoat layer is at least 25%.

26. A photoreceptor according to claim 25 wherein the α,β-ethylenically unsaturated carboxylic acid is methacrylic acid and the α,β-ethylenically unsaturated monomer is methyl methacrylate.

27. A photoreceptor according to claim 25 wherein the weight percent of the first polymer is at least 50%.

28. A photoreceptor according to claim 25 wherein a crosslinking agent is present in a crosslinking effective amount that is less than 5% by weight of the overcoat layer.

29. A photoreceptor according to claim 28 wherein the crosslinking agent comprises an organic cross-linking agent that is a polyfunctional aziridine.

30. A photoreceptor according to claim 25 wherein the charge transport compound comprises at least two carbazole groups and at least two hydrazone groups.

31. A photoreceptor according to claim 25 wherein the charge transport compound comprises at least two heterocyclic groups and at least two hydrazone groups.

32. A photoreceptor according to claim 25 wherein the blend has an acid value of at least 150 mg KOH/g the blend.

33. A photoreceptor according to claim 32 wherein a crosslinking effective amount of a crosslinking agent is present in the overcoat layer and the amount of the crosslinking agent is less than 5%.

34. A photoreceptor according to claim 33 wherein the crosslinking agent is polyfunctional aziridine.

35. A photoreceptor according to claim 32 wherein the charge transport compound is selected from the group consisting of a) a compound having at least two carbazole groups and at least two hydrazone groups and b) a compound having at least two heterocycles and at least two hydrazone groups.

36. A photoreceptor according to claim 1 wherein the α,β-ethylenically unsaturated carboxylic acid is selected from the group consisting of 4-vinylbenzoic acid, fumaric acid, cinnamic acid, sorbic acid, mesaconic acid, maleic acid, glutaconic acid, citraconic acid, itaconic acid, indene-3-carboxylic acid, acrylic acid, methacrylic acid, crotonic acid, 2-methacryloyloxyethyl hydrogen phthalate, 4-methacrylamidobenzoic acid, mono-(2-methacryloyloxyethyl)succinic acid, and 2-methyl-2-pentenoic acid.

37. A photoreceptor according to claim 7 wherein the α,β-ethylenically unsaturated carboxylic acid is selected from the group consisting of 4-vinylbenzoic acid, fumaric acid, cinnamic acid, sorbic acid, mesaconic acid, maleic acid, glutaconic acid, citraconic acid, itaconic acid, indene-3-carboxylic acid, acrylic acid, methacrylic acid, crotonic acid, 2-methacryloyloxyethyl hydrogen phthalate, 4-methacrylamidobenzoic acid, mono-(2-methacryloyloxyethyl)succinic acid, and 2-methyl-2-pentenoic acid.

38. A photoreceptor according to claim 25 wherein the α,β-ethylenically unsaturated carboxylic acid is selected from the group consisting of 4-vinylbenzoic acid, fumaric acid, cinnamic acid, sorbic acid, mesaconic acid, maleic acid, glutaconic acid, citraconic acid, itaconic acid, indene-3-carboxylic acid, acrylic acid, methacrylic acid, crotonic acid, 2-methacryloyloxyethyl hydrogen phthalate, 4-methacrylamidobenzoic acid, mono-(2-methacryloyloxyethyl)succinic acid, and 2-methyl-2-pentenoic acid.

39. A photoreceptor according to claim 1 wherein the acrylates and methacrylates are selected from the group consisting of methyl acrylate, ethyl acrylate, butyl acrylate, methyl methacrylate, ethyl methacrylate, butyl methacrylate, isobornyl acrylate, and isobornyl methacrylate.

40. A photoreceptor according to claim 7 wherein the acrylates and methacrylates are selected from the group consisting of methyl acrylate, ethyl acrylate, butyl acrylate, methyl methacrylate, ethyl methacrylate, butyl methacrylate, isobornyl acrylate, and isobornyl methacrylate.

41. A photoreceptor according to claim 25 wherein the acrylates and methacrylates are selected from the group consisting of methyl acrylate, ethyl acrylate, butyl acrylate, methyl methacrylate, ethyl methacrylate, butyl methacrylate, isobornyl acrylate, and isobornyl methacrylate.

42. A photoreceptor according to claim 25 wherein the first polymer is derived from the α,β-ethylenically unsaturated carboxylic acid and an α,β-ethylenically unsaturated monomer selected from the group consisting of styrene, fluoroolefins, acrylates and methacrylates.

* * * * *